US010787919B2

(12) United States Patent
Congratel et al.

(10) Patent No.: US 10,787,919 B2
(45) Date of Patent: Sep. 29, 2020

(54) MOUNTING OF VANES AT THE PERIPHERY OF A TURBINE ENGINE DISC

(71) Applicant: Safran Aircraft Engines, Paris (FR)

(72) Inventors: Sébastien Congratel, Moissy-Cramayel (FR); Christian Bariaud, Moissy-Cramayel (FR); Dominique Jean André Bousquet, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 307 days.

(21) Appl. No.: 15/323,902

(22) PCT Filed: Jul. 2, 2015

(86) PCT No.: PCT/FR2015/051840
§ 371 (c)(1),
(2) Date: Jan. 4, 2017

(87) PCT Pub. No.: WO2016/005687
PCT Pub. Date: Jan. 14, 2016

(65) Prior Publication Data

US 2017/0145841 A1 May 25, 2017

(30) Foreign Application Priority Data

Jul. 8, 2014 (FR) ..... 14 56554

(51) Int. Cl.
*F01D 9/04* (2006.01)
*F01D 5/30* (2006.01)

(52) U.S. Cl.
CPC ..... *F01D 9/042* (2013.01); *F01D 5/3007* (2013.01); *F05D 2230/60* (2013.01); *F05D 2240/125* (2013.01)

(58) Field of Classification Search
CPC ..... F01D 9/042; F01D 5/3007; F01D 5/14; F01D 5/326; F01D 9/041;
(Continued)

(56) References Cited

U.S. PATENT DOCUMENTS

2002/0085917 A1* 7/2002 Roberts ..... B23P 15/006 416/220 R
2012/0034086 A1 2/2012 Mishrikotkar et al.
2012/0090175 A1* 4/2012 Schmidt ..... B23P 15/006 29/889.7

FOREIGN PATENT DOCUMENTS

EP 1 955 805 A1 8/2008
EP 2 460 980 A2 6/2012
SU 1009689 A1 4/1983

* cited by examiner

*Primary Examiner* — Christopher J Besler
*Assistant Examiner* — Christine Bersabal
(74) *Attorney, Agent, or Firm* — Blank Rome LLP

(57) ABSTRACT

The invention relates to a method of mounting of vanes (10) at the periphery of a turbine engine disc (12),
where in the disc (12) comprises sockets extending in alternation with teeth,
wherein the vanes (10) comprise respectively:
roots designed to be inserted into the sockets,
heels (26) and
blades (24) connecting the roots to the heels.
According to the invention, the method comprises the steps consisting of:
(a) positioning the vanes (10) such that the root of each vane is axially opposite one of the sockets in the disc,
(b) providing a mounting tool (50) featuring an endpiece (40) of a shape partly complementary to the heel (26) of one of the vanes,
(c) causing the endpiece (40) of the mounting tool (50) to cooperate with the heel (26) of the vane,
(Continued)

(d) pivoting the heel (26) of the vane by a rotational movement (54) of the mounting tool (50) and
(e) axially inserting the vane root into the socket of the disc.

9 Claims, 2 Drawing Sheets

(58) Field of Classification Search
CPC ..... F05D 2240/125; F05D 2230/60; B25B 27/02; B25B 27/0028
USPC ..... 29/889, 889.2, 889.21, 889.22
See application file for complete search history.

MOUNTING OF VANES AT THE PERIPHERY OF A TURBINE ENGINE DISC

The invention relates to mounting of vanes at the periphery of a turbine engine, which can be performed during assembly of the turbine engine. The invention will be particularly suitable for discs belonging to a turbine engine low pressure turbine. It concerns a method of mounting, in addition to a specific tool allowing implementation of the method.

A stage of mounting vanes at the periphery of a turbine engine disc is involved within the context of assembly of the components of a turbine engine, either for commercial purposes of complete production of the turbine engine for sale, or for experimental purposes for trials, tests or experiments on the turbine engine or partial elements thereof. The disc is a rotary component of the turbine engine attached to the low pressure shaft or the high pressure shaft of the turbine engine. The vanes, once mounted on the disc, allow energy transfer between the flow circulating through the secondary stream of the turbine engine and one of these shafts.

In order to ensure a structural hold of the vanes around the disc, the disc comprises at its periphery sockets oriented substantially parallel to the axis of the disc and positioned so as to alternate with the teeth of the disc. The vanes comprise roots at their inner ends, which once inserted into the sockets of the disc, are held radially in a form-fitting manner by the teeth of the disc. The vane roots are furthermore extended radially by blades and subsequently by heels forming the outer ends of the vanes. The heels generally comprise external lips, i.e. radially outwards projecting walls, which are intended to cooperate with a radially outer element of the turbine engine. The heels may furthermore comprise axial spoilers, i.e. axial walls designed to extend upstream and/or downstream from the heel in the turbine engine in order to mark out the outer limit of the secondary stream.

In order to assemble the vanes and the disc, all the vanes to be mounted on the disc are grouped together, circumferentially aligned end to end, in a configuration similar to their final state when mounted on the disc. This "crown" of vanes is subsequently positioned in front of the disc such that the vane roots are axially opposite the corresponding sockets of the disc. Mounting is performed by axial displacement of the vanes, one by one, for axial insertion of the roots into the sockets. Optionally, foils are arranged around the roots of the vanes to act as an interface between the roots and the sockets, thereby avoiding their respective wear.

Mounting of the vanes is however rendered difficult by the shape of the heels. Indeed, the heels are oriented so as to circumferentially rest on one another in a direction that is not the same as the direction of introduction of the vane roots into the sockets. Hence, when it is attempted to mount a vane on the disc, the heel of said vane is inhibited in axial movement by the heels of the adjacent vanes.

In order to allow mounting of the vanes, wedges made of wood, plastic or other material are currently used, which are inserted between the blades of the vanes and hold the vanes apart from one another. The heels therefore no longer rest on one another and the vane can be slid into the socket without the heels being held. Wedges of this kind may however easily cause deformations, impacts or scratches on the blades, which may impair the mechanical strength of the vanes and result in discarding of some vanes and repeat mounting of the vanes on the disc. It has furthermore been noticed that this method makes it difficult to properly insert the foils into the sockets.

It also happens that the vanes are spaced manually, which obviously involves risks of occupational accidents for the hander.

EP2460980 teaches that vanes can be inserted into sockets in the radial direction of the rotor body using a device to be installed in the area of the vane roots. This imposes operational constraints. Moreover, no information is provided concerning the device involved.

The present invention provides a simple, effective and economical solution to facilitate mounting of the vanes on the disc.

To this end, it proposes a method of mounting vanes at the periphery of a turbine engine disc in relation to the axis of rotation of the disc, wherein the disc comprises, at its radially external periphery, sockets extending substantially parallel to the axis of the disc and positioned so as to alternate with the teeth of the disc, wherein the vanes comprise respectively:

at a radially inner end, roots designed to be inserted into sockets in the disc, at a second radially outer end, heels and blades connecting the roots to the heels, wherein the method comprises the steps consisting of:

(a) positioning the vanes in circumferential alignment such that the root of each vane is axially opposite one of the sockets in the disc, (b) providing a mounting tool featuring an endpiece of a shape partly complementary to the heel of one of the vanes, (c) causing the endpiece of the mounting tool to cooperate with the heel of the vane, (d) pivoting the heel of the vane by a rotational movement of the mounting tool around a radial direction of the disc passing through the vane and (e) axially inserting the vane root into the socket of the disc.

In order to allow mounting of one of the vanes, the latter's heel is therefore pivoted round in the radial direction until its support with the adjacent heels is in the same direction as the direction of insertion of the vanes in the sockets. It is therefore possible to slide the vane into the socket without the heel being held. The tool used, when set in rotation in order to pivot the heel, does not cause any excessive localised constraints to the vane, owing to its shape that is complementary to the heel. Handling is in addition very easy and quick for a user and is unlikely to be unsuccessful. It has furthermore been noticed that the invention allows better engagement of the foils in the sockets of the disc.

In one specific embodiment, following step (a), the heels of the vanes circumferentially rest on one another according to edges oriented in a different direction from that in which the vane roots are oriented.

Advantageously, the method involves as many vanes to be mounted on the disc as there are sockets in the disc and steps (b), (c), (d) and (e) are repeated successively for all the vanes.

Preferentially, all the vanes are identical in shape and one single mounting tool is used during repetition of steps (b), (c), (d) and (e).

A foil can be mounted around the vane root prior to step (a), the foil being inserted into the socket with the vane root during step (e). The foil enables reduction in wear of the vane roots and sockets.

Advantageously, the mounting tool comprises gripping means, such as a handle.

Preferentially, the gripping means and the endpiece of the mounting tool are detachable in relation to one another. It is thus possible to manufacture several endpieces that are complementary to different types of vane, while using the same gripping means that can be connected interchangeably to each of these endpieces.

According to one specific embodiment, the endpiece of the mounting tool comprises two axial stops between which the axial ends of the heel are fitted with a small clearance during step (c). During step (c), the heel is therefore caught by the mounting tool between two tops, which means that rotation of the tool causes rotation of the heel by contact reaction.

According to one notable embodiment, the endpiece of the mounting tool comprises at least one slot in which at least one lip of the heel of the vane is fitted with a small clearance during step (c). This allows the mounting tool to achieve an even better hold on the heel during rotation.

The invention furthermore relates to a vane mounting tool intended for mounting vanes at the periphery of a turbine engine disc as described above, comprising an endpiece of a shape partly complementary to the heel of a vane, so as to be able to solidly attach in rotation the heel and the mounting tool, particularly around the direction of extension of the vane corresponding to the direction of alignment between the root, blade and heel.

The endpiece may comprise a face with two shoulders opposite each other extending from the latter, designed to be positioned opposite the axial ends of the heel of a vane, wherein said face furthermore comprises, between the two shoulders, at least one slot oriented substantially parallel to the shoulders and designed to cooperate with a lip of the heel of a vane.

Other details, characteristics and advantages of the invention will appear upon reading the following description given by way of a non-restrictive example while referring to the appended drawings wherein.

Figure 1:
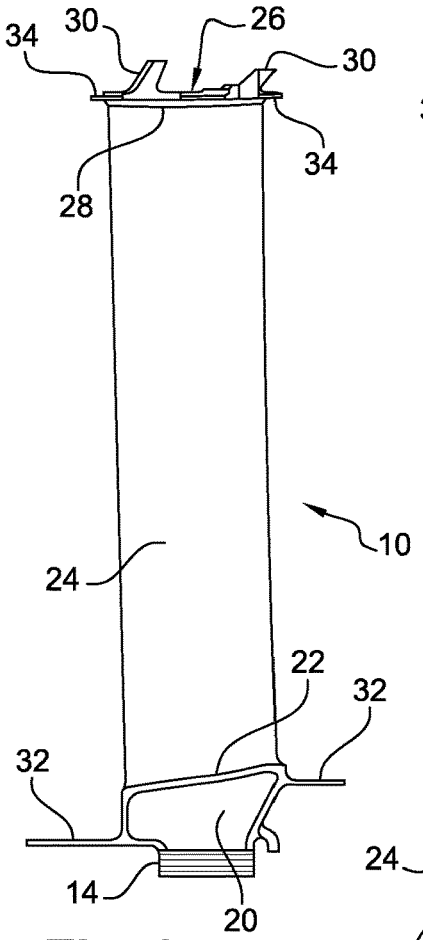
FIG. 1 is a side view of a vane designed to be mounted on a turbine engine disc.

By reference to FIG. 1, a vane 10 designed to be mounted on a disc 12 of a turbine engine is described. More particularly, the example of a vane illustrated and of a disc thereafter, corresponds to a low-pressure turbine stage of the turbine engine.

The vane extends longitudinally in a so-called radial direction, with reference to the radius of the turbine engine of axis 16. The radially inner part of the vane is a root 14, designed to be mounted in a socket 18 of a disc and extended externally by a stilt 20, followed by a platform 22 and subsequently by a blade 24 and finally by a heel 26. The heel consists of a platform 28 and furthermore comprises lips 30 on its outer face, which are walls extending substantially radially outwards and circumferentially. The blade is designed to interact with the gas flow circulating through the turbine engine in order to exchange the latter's energy with the disc 12. The two platforms 22, 28 are walls extending cylindrically on either side of the vane 10 and respectively delimit internally and externally the stream in which the gas flow circulates. Spoilers 32, 34 furthermore extend upstream and downstream from the inner platform 22 and the external platform 28 for the same purpose.

Figure 2:
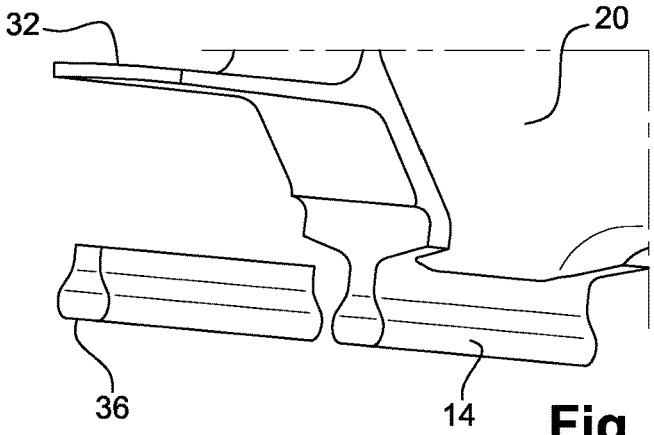
FIG. 2 is view of a foil adapted to the vane root in FIG. 1.

It can be seen in FIG. 2 that the root 14 of the vane has a bulbous shape substantially complementary to the shape of a socket 18 of the disc 12. It is usual to mount a foil 36 on the root 14 of each vane 10, i.e. a wall surrounding the root while matching its shape, which will serve to protect against wear the walls of the root and of the socket in which it is installed.

Figure 3:
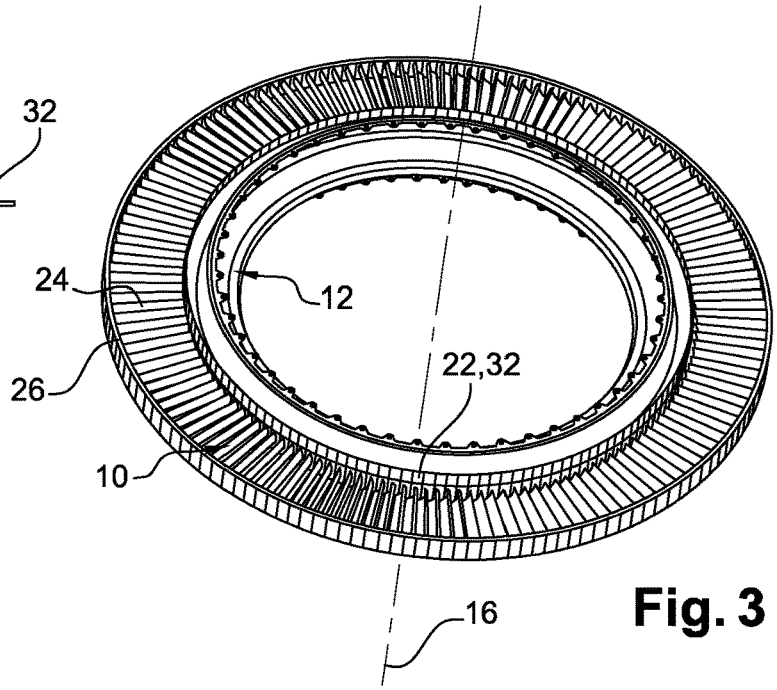
FIG. 3 is a view of the disc and of the vanes following step (a) of the invention.
Figure 4:
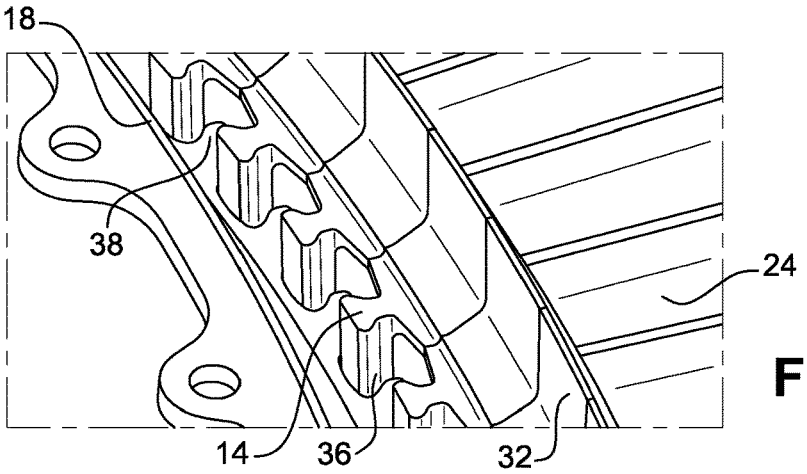
FIG. 4 is a magnification of the boxed area in FIG. 3.

In FIGS. 3 and 4, the disc 12 can be seen, at the periphery of which all the vanes have been prepositioned with a view to their mounting. The vanes 10 are positioned circumferentially end to end, such that the platforms 22, 28 of the vanes are in circumferential contact with one another, whether this involves the inner platforms 22 or external platforms 28 of the vanes. It is also apparent that the teeth 38 of the disc serve to radially hold the vanes 10 when the roots 14 are mounted in the sockets 18. The inner platforms 22 of the vanes have their circumferential edges oriented in the same direction as the direction of insertion of the roots 14 in the sockets 18.

All the vanes 10 are offset axially in relation to their final positions, such that the roots 14 of the vanes are axially opposite the sockets 18 of the disc 12 before their mounting.

Figure 5:
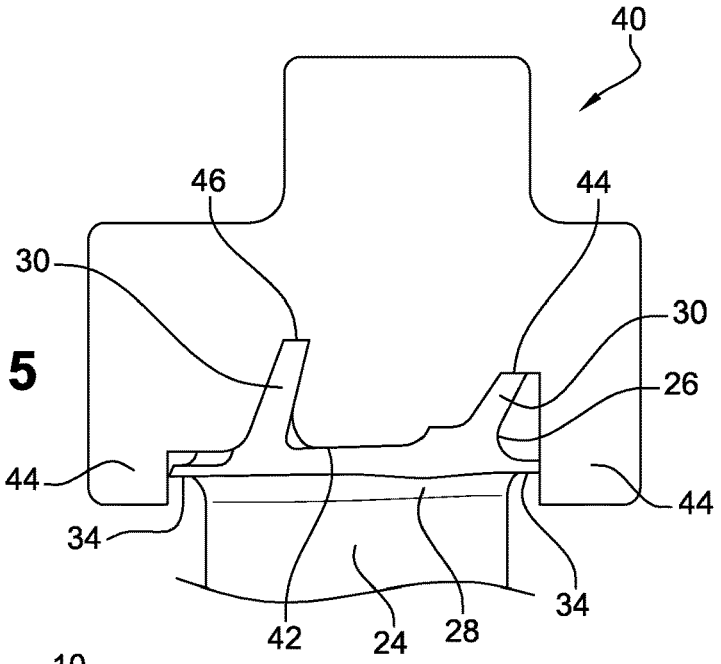
FIG. 5 is an endpiece of a shape complementary to the heel of the vane in FIG. 1.

FIG. 5 shows the endpiece 40 of the mounting tool 50 according to the invention, which is complimentary in shape to the heel 26 of one of the vanes 10 and can serve to rotate the heel 26 in the radial direction. In order to allow a good hold of the heel 26 when the vanes are arranged as shown in FIGS. 3 and 4, the endpiece 40 is intended to be engaged from the outside of the heel 26. The endpiece embraces the shape of the heel from outside with a small clearance, such that any rotation of the endpiece 40 in the radial direction results in rotation of the heel by contact reaction with the parts engaged with the heel 26. It will readily be noted that the more the form fitting between the endpiece and heel is complete and tight, the more the contact reaction will be distributed over the entire heel 26, which avoids excessive concentrations of mechanical stresses.

To this end, according to the example illustrated in FIG. 5, which relates to the type of vane introduced in FIG. 1, the endpiece has an inner face 42 that rests on the outer face of the heel 26. Inwardly directed edges 44 are located upstream and downstream from the endpiece which form two upstream and downstream shoulders substantially perpendicular to the inner face 42 of the endpiece. These shoulders are spaced so as to abut against the upstream and downstream ends of the upstream and downstream spoilers 34 of the heel 26 when the mounting tool is in engaged.

Furthermore, the inner face 42 of the endpiece 40 comprises between the two shoulders 44 at least one slot 46, generally two slots 46, extending circumferentially in the endpiece and oriented substantially parallel to the shoulders, wherein the slot(s) has/have a complementary shape matching each of the lips 30 of the heel, which are introduced when the mounting tool is in engaged.

Figure 6:
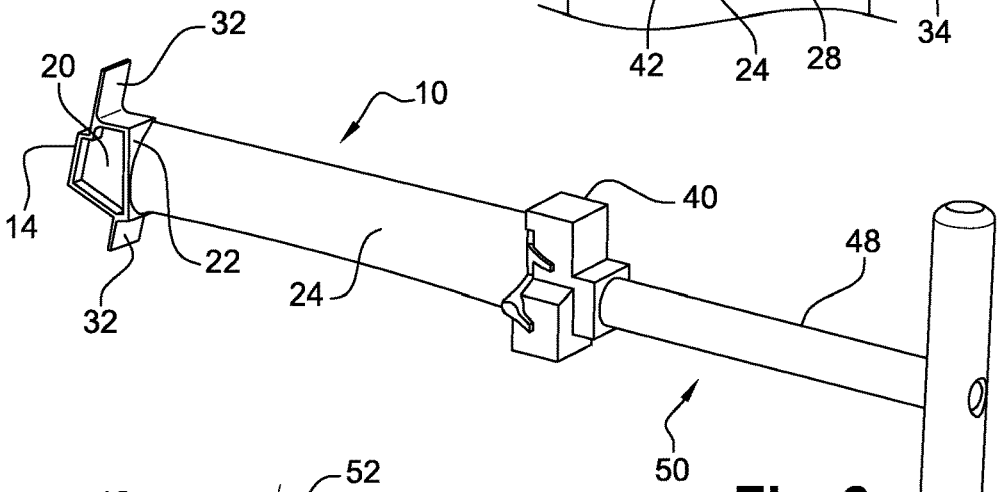
FIG. 6 is a view of the complete mounting tool comprising the endpiece in FIG. 5.

In FIG. 6, it can be seen that the endpiece 40 may be connected to gripping means 48, such as a conventional handle. This connection is detachable in order to be able to keep the same gripping means 48 for different types of endpieces 40 corresponding to other types of vanes 10 than those exemplified. It can be clearly seen in FIG. 6 that the mounting tool is engaged from the outside of the vane 10 and leaves the circumferential edges of the heel 26 free while placing in contact the upstream and downstream edges of the heel 26.

Figure 7:
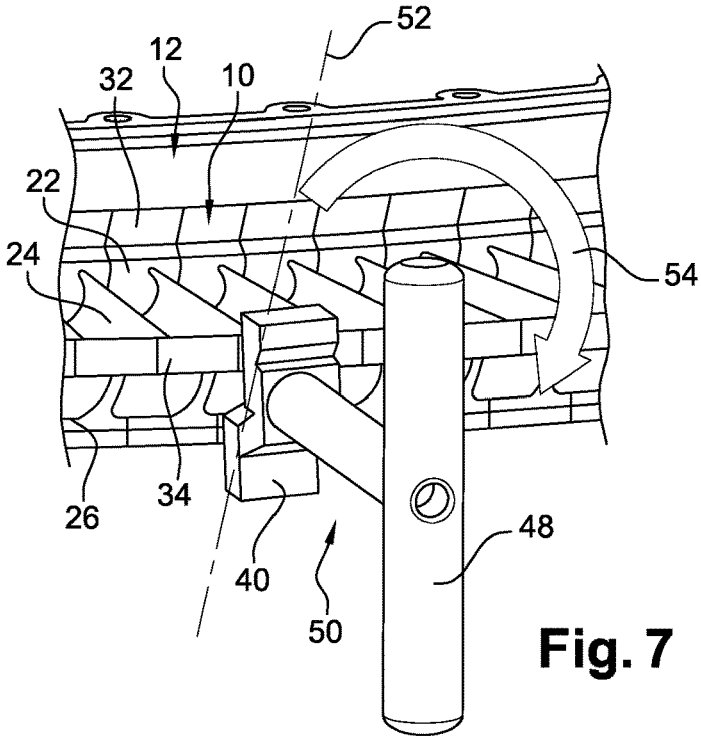
FIG. 7 is a diagram showing use of the mounting tool according to the invention.

FIG. 7 shows the way in which the mounting tool 50 is used to engage the vanes 10 in the sockets 18 of the disc 12. Whereas the insertion direction 52 of the roots 14 of the vanes into the sockets 18 is slightly angled in relation to the axis 16 of the disc, as are the circumferential edges of the inner platforms 22 of the vanes 10, it can be seen that the outer platforms 28 of the heels 26 of the vanes have their circumferential edges aligned and resting on one another in the strictly axial direction. This difference in angle means that in the natural state, it is impossible to insert the vanes 10 into the sockets 18 without the heels 26 of the vanes interfering with the movement.

By means of the mounting tool 50 described above, the heels 26 of the vanes are pivoted (see arrow 54) by elastic deformation in the radial direction such that the circumferential edges of the outer platforms 28 align in the direction 52 of insertion of the roots 14 into the sockets 18. Once the heel has been reoriented, the vane 10 can be slid into the socket 18 without any particular disturbance of the adjacent vanes. This handling operation can be repeated for each vane in order to mount the entire set of vanes on the disc.

The invention claimed is:

1. Method of mounting vanes at the periphery of a turbine engine disc in relation to the axis of rotation of the disc, wherein the disc comprises, at its radially external periphery, sockets extending substantially parallel to the axis of the disc and positioned so as to alternate with teeth of the disc, wherein the vanes have each a first end being a radially inner end and a second end being a radially outer end, and comprise respectively:

at the first radially inner end, roots designed to be inserted into sockets in the disc through respective entrances of said sockets, at the second radially outer end, heels, each heel having a first lip and a second lip, and blades connecting the roots to the heels, wherein the method comprises the step consisting of:

(a) positioning at least one of the vanes in said entrance of at least one of the sockets, in circumferential alignment such that the root of said at least one of the vanes is axially opposite one of the sockets in the disc, wherein the method also comprises steps consisting of:

(b) providing a mounting tool featuring an endpiece of a shape partly complementary to the heel of one of the vanes and having a first slot and a second slot, (c) causing the respective complementary shapes of the endpiece of the mounting tool and the heel of the vane to be engaged therebetween so that the first lip is engaged in the first slot and the second is engaged in the second slot, (d) pivoting the heel of the vane by a rotational movement of the mounting tool around a radial direction of the disc passing through the vane, so that the vane is rotated around said radial direction while a contact reaction occurs within the first and second lips, which is distributed over the heel and limits accordingly mechanical stress in the vane, and (e) axially inserting the vane root into the socket of the disc.

2. The method of mounting vanes according to claim 1, wherein following step (a), the heels of the vanes circumferentially rest on one another according to edges oriented in a different direction from that in which the vane roots are oriented.

3. The method of mounting vanes according to claim 1, wherein the method involves as many vanes to be mounted on the disc as there are sockets in the disc and steps (b), (c), (d) and (e) are repeated successively for all the vanes.

4. The method of mounting vanes according to claim 3, wherein all the vanes are identical in shape and one single mounting tool is used during repetition of steps (b), (c), (d) and (e).

5. The method of mounting vanes according to claim 1, wherein a foil is mounted around the vane root prior to step (a), the foil being inserted into the socket with the vane root during step (e).

6. The method of mounting vanes according to claim 1, wherein the mounting tool comprises gripping means such as a handle.

7. The method of mounting vanes according to claim 6, wherein the gripping means and the endpiece of the mounting tool are detachable in relation to one another.

8. The method of mounting vanes according to claim 1, wherein the endpiece of the mounting tool comprises two axial stops between which the axial ends of the heel are fitted with a small clearance during step (c).

9. The method of mounting vanes according to claim 1, wherein the endpiece of the mounting tool comprises at least one slot in which at least one lip of the heel of the vane is fitted with a small clearance during step (c).

* * * * *